United States Patent [19]

Dalton

[11] Patent Number: 4,690,334

[45] Date of Patent: Sep. 1, 1987

[54] AUTOMATICALLY ADJUSTABLE SHOWER HEAD TO MAINTAIN CONSTANT PRESSURE SPRAY

[75] Inventor: Martin W. Dalton, Solihull, United Kingdom

[73] Assignee: Triton Aquatherm Limited, Warks, England

[21] Appl. No.: 705,081

[22] Filed: Feb. 25, 1985

[30] Foreign Application Priority Data

Feb. 25, 1984 [GB] United Kingdom ..... 8404976

[51] Int. Cl.[4] ..... B05B 1/18; B05B 1/30

[52] U.S. Cl. ..... 239/452; 239/460; 239/533.1

[58] Field of Search ..... 239/452, 453, 456, 458, 239/459, 460, 533.1, 570, 571, 562

[56] References Cited

U.S. PATENT DOCUMENTS

| | | | |
|---|---|---|---|
| 2,948,477 | 8/1960 | Fraser | 239/460 X |
| 2,990,123 | 6/1961 | Hyde | 239/453 |
| 3,380,664 | 4/1968 | Miller et al. | 239/460 X |
| 3,383,051 | 5/1968 | Fiorentino | 239/460 |

FOREIGN PATENT DOCUMENTS

| | | | |
|---|---|---|---|
| 442165 | 1/1968 | Switzerland | 239/453 |
| 664125 | 10/1950 | United Kingdom | 239/459 |
| 1111126 | 4/1968 | United Kingdom | 239/460 |

*Primary Examiner*—Andres Kashnikow
*Attorney, Agent, or Firm*—Kenway & Jenney

[57] ABSTRACT

A shower spray device comprises a head (1) including a chamber and fluid paths to supply water thereto, an outer wall (2) of the chamber being formed from a plurality of concentric spray rings (3,4,5), serrations **(9,10,10*a*) formed in the wall of one ring defining in co-operation with the wall of an adjacent ring, apertures (9*a*, 11,11*a*) through which water is emitted; one of the spray rings (4) being movable with respect to a fixed adjacent ring (3) against a spring (8,14) contained in the head, the walls of the movable (4) and adjacent fixed ring (3) being angled relative to each other whereby movement of the movable ring in response to changes in inlet water pressure results in a change in size of the apertures (11,11*a*) defined therebetween to provide that the water pressure emitted through the apertures (11,11*a*,9*a*)** remains substantially constant.

12 Claims, 5 Drawing Figures

1
7a
7a
7
7
-6-
8
8a
-5-
9
9a
9a
11
11
3
10
4
2

10a
4a
11a
3a

AUTOMATICALLY ADJUSTABLE SHOWER HEAD TO MAINTAIN CONSTANT PRESSURE SPRAY

The present invention relates to improvements in in apparatus for spraying liquids, especially shower bath spray heads.

Fluctuations in water pressure at spray heads, for example those used in shower baths, causes the force of water emitted through the spray head orifices to vary. Thus at high pressures the "spray" is said to be hard, whilst at low pressures a "soft" spray results and at very low pressures there may be a total loss in spray pattern. For spray heads used in shower baths it is preferable that the "spray" be "soft" although at the same time, a definite or true spray pattern is required to be retained.

We have now developed a spray head especially suitable for use with shower baths installations, for example in hand sets, which permits the spray pattern to be adjusted such that a "soft" spray pattern is obtained at high liquid, for example water, throughputs whilst maintaining a true spray pattern at lower liquid throughputs.

This effect may be achieved by providing that the volume of liquid to the spray apparatus is controlled by means contained within the spray head or by providing means whereby the size of the spray apertures is increased with increasing liquid pressure, a decrease in size of the apertures occurring as the pressure drops again.

Accordingly, therefore, the present invention provides a liquid spraying device comprising; a spray head and means to supply liquid under pressure to a chamber located within said head, said head including a face element forming an outer wall of said chamber, said face element containing a plurality of apertures communicating therewith and arranged to define a spray pattern of liquid emitted through said apertures, wherein said spray head further includes means for controlling the pressure of liquid emitted from the said apertures whereby a defined soft spray pattern (as herein defined) is maintained at variable liquid input pressures.

For use with shower bath installations it is preferable that the size of the apertures at zero flow rate is such that a true spray pattern will be achieved at water pressures of 2.65 cm Hg pressure (36 inches water) and above.

In a handset in which the apertures are formed by the use of concentric serrated spray rings, control of the pressure of water emitted through the apertures may be obtained by providing that at least one of the spray rings is movable against a resilient means located within the spray heads and in response to an increase or decrease in water pressure, the spray rings being constructed such that the said movement results in an increase or decrease in the size of the spray ring apertures.

Figures 1, 1A:
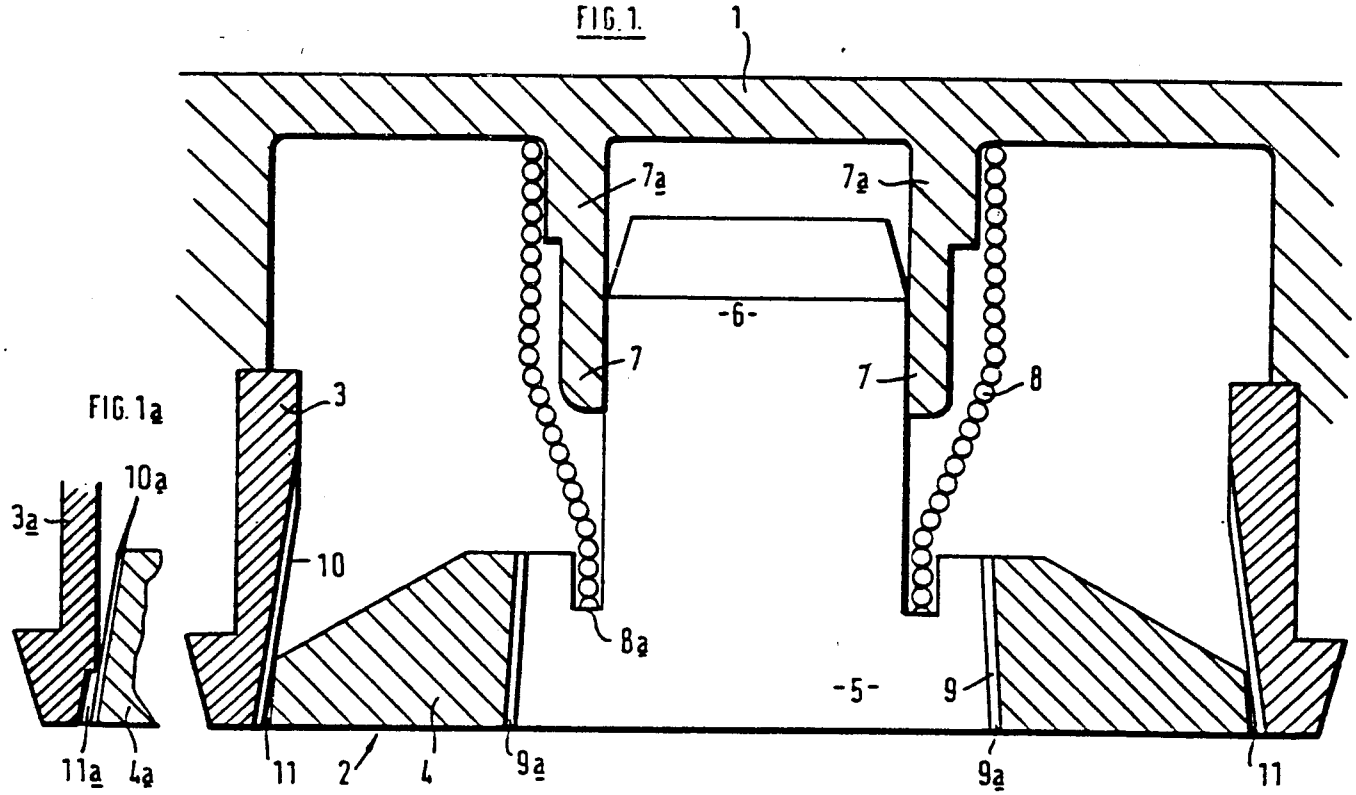
Figure 2:
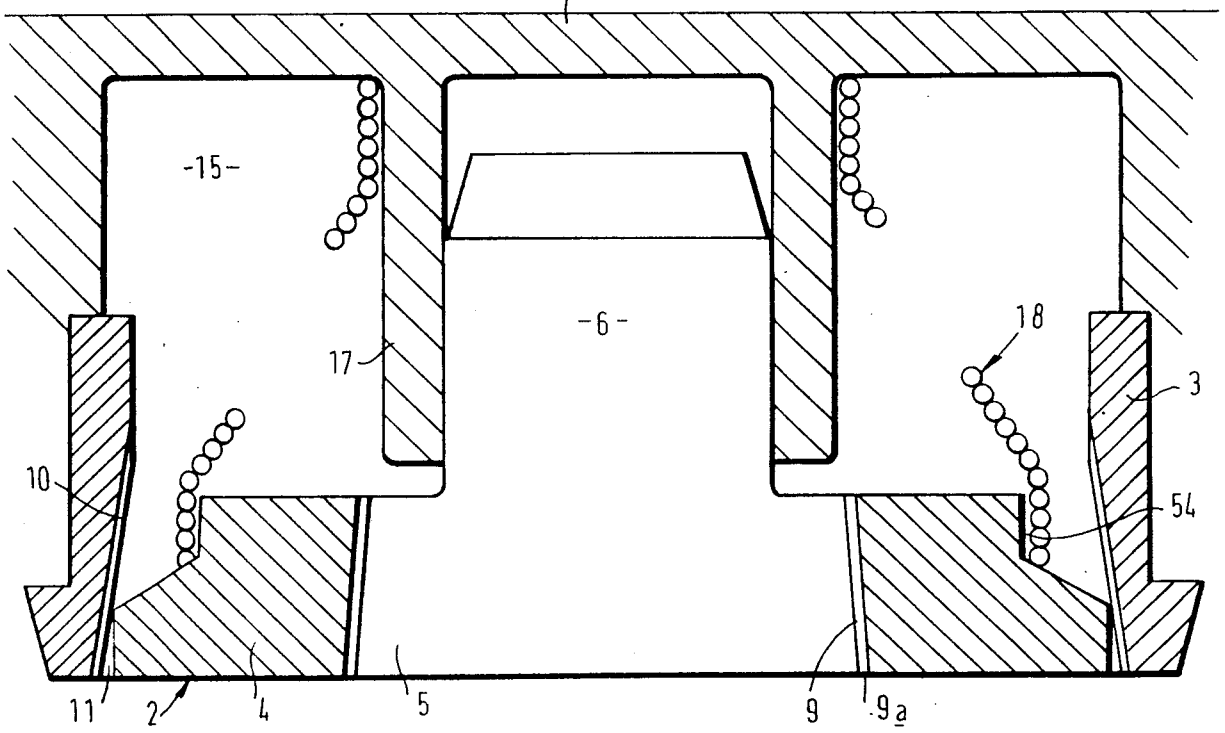
Figure 3:
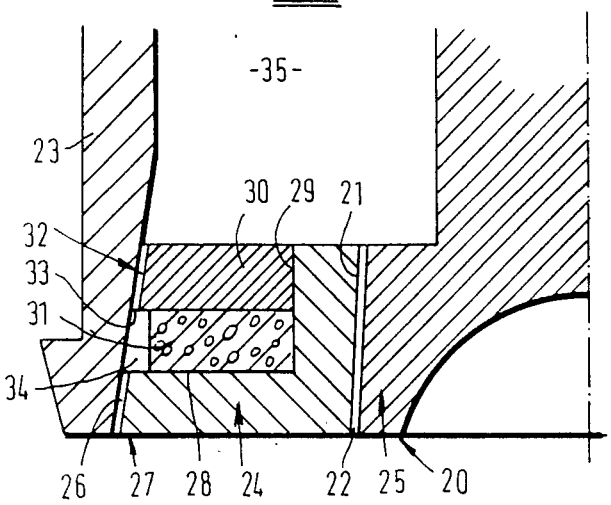
Figure 4:
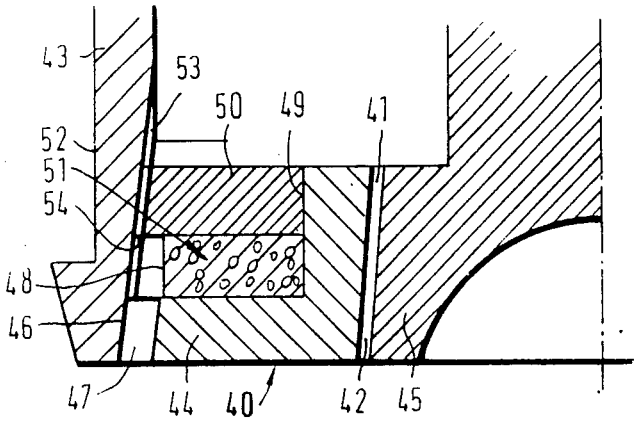

Embodiments of the invention will now be described with reference to the drawings in which:

FIG. 1 is a diagrammatic representation of a cross section of a spray ring assembly in a handset shower head, FIG. 1*a* is a variation in the assembly of FIG. 1, FIG. 2 is a variation of the assembly of FIG. 1, FIG. 3 is a part cross-sectional representation of a second embodiment of a spray ring assembly, FIG. 4 is a part cross-sectional representation of a third embodiment of a spray ring assembly.

In FIG. 1 the handset body 1 includes a spray ring assembly 2 having an outer spray ring 3 attached to the body 1, and inner spray rings 4 and 5 fixed in relation to each other and carried on a centre cylindrical member 6 which is in sliding engagement with tubular member 7 extending inwardly of body 1. Serrations 9 on central spray ring 5 provide in co-operation with the inner wall of ring 4 a first inner ring of apertures 9*a* in the face of the spray head which apertures communicate via the serrations with the hollow interior 15 of the body 1. Serrations 10 formed on the inner wall of the outer spray ring 3 provide, in co-operation with the uppermost corner of the outer wall of ring 4, a second ring of apertures 11 in the face of the spray head which also communicates with interior 15 of body 1.

A tension spring 8 is located between body 1 and an inner groove 8*a* in ring 5 and retains spray rings 4 and 5 at their innermost position.

In FIG. 1*a*, a variation in the design of spray rings 3 and 4 is illustrated. In this modification the serrations 10*a* are formed in spray ring 4*a* and the bottom end of spray ring 3*a* is stepped to provide apertures 11*a*.

In use water enters the hollow portion 15 of body 1 and flows out through apertures 9*a* and 11 as a fine spray. When the water pressure reaches a predetermined level it will force spray rings 4 and 5 outwardly of body 1 against tension spring 8. As the outer edge of ring 4 moves away from the serrations 10 in ring 3 there is an increase in the size of apertures 11 which results in a softer spray than if rings 4 and 5 had been maintained in their innermost positions. A subsequent decrease in water pressure causes tension spring 8 to withdraw spray rings 4 and 5 back into body 1 reducing the size of apertures 11 and maintaining a definite spray pattern until the pressure of water falls below about 2.6 cm Hg pressure.

The embodiment of FIG. 2 is a further variation of that of FIG. 1, the inner sprary ring 4 being formed with shoulders 54 about which one end of tension spring 18 is wrapped to retain the spray ring assembly 2 in its innermost position, the other end being wrapped about the upper portion 7*a* of the tubular portion 7.

In the embodiment illustrated in FIG. 3, which represents a half of spray ring assembly 20, the outer spray ring 23, the inner annular spray ring 24 and central portion 25 are all located in positions fixed in relation to the spray head body. Serrations 21 formed in the outer wall of portion 25 provide apertures 22 and serrations 26 formed in the outer wall of spray ring 24 provide apertures 27. Serrations 26, are, however, deeper than serrations 21 thereby providing that the apertures 27 are substantially larger than apertures 22.

The inner portion of spray ring 24 is machined to provide a flat annular surface 28, parallel to the face of the spray ring, and a shoulder portion 29. A closed-cell sponge or wavey spring washer 31 is located on shoulder 28 and supports an inner floating spray ring 30 the outer edges of which include serration 32 which form a ring of inner apertures 33 having the same size as apertures 22.

In use water enters the area 35 behind the spray ring assembly 20 and is emitted as a spray from apertures 22 and 27. The water flowing from apertures 27, however, first flows through apertures 33 into space 34 between the floating spray ring 30 and surface 28 of spray ring 24. When the water pressure exceeds a predetermined level the inner spray ring 30 will be pressed against the sponge or wavey washer thereby increasing the size of aperture 33 to allow an increased flow of water therethrough whereby the spray emitted from apertures 22 and 27 remains "soft". A reduction in water pressure will cause spray ring 30 to be returned towards its original position by the resilient sponge or washer 31, which movement increases the pressure of water entering the space 34 and maintains a true spray pattern from apertures 22 and 27.

The embodiment in FIG. 4 is a variation of that in FIG. 3.

A spray ring assembly, only half of which is shown, generally indicated at 40 includes an outer spray ring 43, an inner spray ring 44 and a central portion 25, secured in fixed relationship to the spray head body. Serrations 41, formed in the outer peripheral wall of spray ring 44 define in co-operation with the inner peripheral wall of portion 25, spray apertures 42. Spray ring 44 is dimensioned to provide an annular gap 46 between the outer spray ring 43 and the inner spray ring 44 which gap is filled by a web 47 that may consist of four or six location membranes i.e., membranes that act between the adjacent walls of rings 43 and 44 to retain inner ring 44 in a substantially fixed position relative to the outer ring 43.

As in the device of FIG. 3 the upper portion of spray ring 44 is machined to provide a flat annular surface 48 and a shoulder 49. A closed cell sponge or wavey washer 51 is located on shoulder 49 and supports an inner annular floating spray ring 50. Serrations 53 are cut in upper portion 52 inner peripheral wall of outer spray ring 43 to form, in co-operation with floating ring 50 a second ring of apertures 54, having the same dimensions as apertures 42.

The operation of the device of FIG. 4 is essentially the same as that in respect of FIG. 3 except that the streams of water passing through the annular gap are broken up by web 47.

I claim:

1. A water spraying device comprising: a spray head and means for supplying water under pressure to a chamber located within said head, said head including a face element comprising a plurality of annular concentric spray rings, each ring having an inner and an outer peripheral wall extending axially of said face element, the outer peripheral wall of one ring lying adjacent the inner peripheral wall of a second ring, a plurality of spray ring apertures communicating with said chamber being formed by axially directed serrations cut in the peripheral wall of at least one of said adjacent rings to define a spray pattern of water emitted from said apertures, wherein the pressure of water emitted from said apertures is controlled by means for automatically varying the size of the apertures in response to changes in water pressure whereby the pressure of water emitted from said apertures is maintained substantially constant at variable water input pressures.

2. A device according to claim 1 wherein the apertures in the face element are dimensioned to provide that a defined spray pattern is obtained at a water pressure of 2.65 cm of mercury.

3. A device according to claim 1 wherein at least one of said spray rings is movable axially of said face element relative to an adjacent fixed ring and against a resilient means contained within the spray head, the adjacent peripheral walls of said movable and fixed rings being angled to provide that said movement results in an increase or decrease in the size of the spray ring apertures defined by said rings in response to an increase or decrease in inlet water pressure, whereby variations in the pressure of liquid emitted through the spray apertures is controlled.

4. A device according to claim 3 wherein the resilient means is a tension spring acting to retain said movable ring in a position in which the apertures defined by the said ring and the said fixed ring have minimum dimensions.

5. An apparatus according to claim 4 wherein one of said movable spray rings and the wall of said chamber opposite to said face element includes an inwardly directed cylindrical member slidably engaging a concentric tubular member extending from the other of said rings and said opposite wall, said spring acting between said opposite wall and said movable ring.

6. A device according to claim 5 wherein one end of a spring forming the resilient means is secured to said tubular member and the other end is secured to means forming part of the said opposite wall or said movable ring.

7. A device according to claim 5 wherein one end of a spring forming the resilient means is secured to the tubular member and the other end is secured to said cylindrical member.

8. A device according to claim 1 wherein at least an outer portion of each said spray ring is fixed relative to the spray head, at least one of said spray rings comprising; an outer annular ring portion defining, in co-operation with an adjacent ring, a plurality of apertures of fixed dimensions, and an inner concentric annular ring portion movable axially of said outer portion under the influence of inlet water pressure and against resilient means positioned between said ring portions, said movable inner ring having a peripheral outer wall lying adjacent the inner peripheral wall of said adjacent ring, a second series of apertures communicating with said first series and the said chamber being formed by axially directed serrations cut in the perpheral wall of at least one of said inner rings and said adjacent ring, said second series of apertures being of smaller dimension than said first series at zero water pressure, the peripheral outer wall of said inner ring and the peripheral inner wall of said adjacent ring being angled relatively one to the other to provide that when the inner ring portion is urged towards said outer ring portion the dimensions of the said second series of apertures are increased to maintain the pressure of water emitted through said first series of apertures substantially constant.

9. A device according to claim 8, wherein the said resilient means is a wavey washer or closed cell sponge.

10. A device according to claim 1 wherein at least an outer portion of each said spray ring is fixed relative to the spray head, at least one of said spray rings comprising; an outer annular ring portion defining, in co-operation with an adjacent ring, an annular gap in said face element and an inner concentric annular ring portion movable axially of said outer portion under the influence of inlet water pressure and against resilient means positioned between said ring portions, said movable inner ring having a peripheral outer wall lying adjacent the inner peripheral wall of said adjacent ring, a second series of apertures communicating with said annular gap and the said chamber being formed by axially directed serrations cut in the peripheral wall of at least one of said inner rings and said adjacent ring, the peripheral outer wall of said inner ring and the peripheral inner wall of said adjacent ring being angled one to the other to provide that when the inner ring portion is urged towards said outer ring portion the dimensions of the said series of apertures are increased to maintain the pressure of water emitted through said annular gap substantially constant, said annular gap containing a web capable of breaking up the annular stream of water being emitted therethrough.

11. A device according to claim 10 wherein the said web comprises a series of location rings.

12. A device according to claim 10 wherein the said resilient means comprises a wavey washer or closed cell sponge.

* * * * *